US005673499A

United States Patent [19]

Attilieni

[11] Patent Number: 5,673,499

[45] Date of Patent: Oct. 7, 1997

[54] FOOTWEAR TONGUE WITH REMOVABLE DECORATIVE ELEMENT

[75] Inventor: Attilio Attilieni, Lucca, Italy

[73] Assignee: Stefcom S.p.A., Lucca, Italy

[21] Appl. No.: 510,652

[22] Filed: Aug. 3, 1995

[30] Foreign Application Priority Data

| | | | |
|---|---|---|---|
| Aug. 4, 1994 | [IT] | Italy | MI940580 U |
| Sep. 12, 1994 | [IT] | Italy | MI940618 U |

[51] Int. Cl.[6] ..... A43B 23/26; A43B 23/00; F21L 15/08

[52] U.S. Cl. ..... 36/54; 36/137; 362/103

[58] Field of Search ..... 36/132, 136, 137, 36/139, 112, 54; 362/103

[56] References Cited

U.S. PATENT DOCUMENTS

| | | | |
|---|---|---|---|
| 1,229,940 | 6/1917 | Gomes | 36/136 X |
| 2,454,335 | 11/1948 | Nichols | 36/54 X |
| 2,632,093 | 3/1953 | De Merolis et al. | 36/137 |
| 3,596,291 | 8/1971 | Thill | 2/245 |
| 4,697,362 | 10/1987 | Wasserman | 36/136 |
| 4,712,319 | 12/1987 | Goria | 36/136 X |
| 4,805,321 | 2/1989 | Tonkel | 36/54 |
| 5,149,489 | 9/1992 | Crews | 36/137 X |
| 5,329,432 | 7/1994 | Bland | 362/103 |
| 5,456,032 | 10/1995 | Matsumoto et al. | 36/136 X |
| 5,457,900 | 10/1995 | Roy | 36/136 X |
| 5,465,197 | 11/1995 | Chien | 36/137 X |
| 5,530,626 | 6/1996 | Norment | 36/136 |

FOREIGN PATENT DOCUMENTS

| | | | |
|---|---|---|---|
| 0403926 | 12/1990 | European Pat. Off. | 36/136 |
| 856.287 | 6/1940 | France . | |
| 1 836 153 | 5/1961 | Germany . | |
| 483210 | 4/1938 | United Kingdom | 36/137 |

*Primary Examiner*—B. Dayoan
*Attorney, Agent, or Firm*—Young & Thompson

[57] ABSTRACT

An item of footwear of the type having a body of the footwear and at least one decorative element, the item of footwear including a decorative element removably attached to the body of the footwear. The removable decorative element may be attached to a removable portion of the tongue of the item of footwear. The decorative element may include a light emissive element.

15 Claims, 6 Drawing Sheets

FOOTWEAR TONGUE WITH REMOVABLE DECORATIVE ELEMENT

BACKGROUND OF THE INVENTION

1. Field of the Invention

The present invention relates to an item of footwear and more particularly to a shoe with at least one decorative element suitable for providing the shoe with a special ornamental quality.

2. Description of the Related Art

Shoes of the type referred above and provided with a decorative element in the form, for example, of a face of an animal or of a cartoon character are currently already known.

In these known shoes said decorative elements are generally provided on the tongue of the shoe and namely at the upper end of the latter which projects above the main part of the shoe, where they are fully visible and perform a significant ornamental function.

Such a type of shoe is especially, but not exclusively, dedicated to young customers, such as teenagers and children.

It is a known fact that fashion trends, in order to involve above all younger people in buying, force producers and retailers of fashion articles in general, and of shoes in particular, to change each year the models of the articles offered for sale, with the unfortunate result that a large quantity of articles which have been produced in excess and which have not been sold during the year of production are unlikely to be sold the following year.

This entails serious financial damage, not only for those in the industry, but also for the general public, due to the waste of resources required for producing unsold, and hence not used, batches of material, which could have been allocated otherwise to other uses of greater or equal utility.

The present invention sets out to remedy, at least in the area of footwear, what is referred above, in particular for those items of footwear provided with decorative elements which, by exerting a strong appeal on purchasers, may guide them towards one or the other shoe according to the ornament it bears.

It is also wholly evident that the tastes and choices of the purchaser can only be exactly known at the time of purchase of the footwear, and not before, for example when producing the footwear itself. Therefore it is impossible to plan in advance the number of articles of a given product which have to be manufactured. For the solution to the above mentioned problem to be effective, it is necessary therefore for it to be implemented by the retailer at the precise moment of selling the product. It must therefore be simple to implement and such that it does not require the use of special instruments or expensive equipment.

SUMMARY OF THE INVENTION

According to the present invention, the above can be achieved by providing, an item of footwear of the type comprising a main part of the footwear and at least one decorative element, said item of footwear characterized in that suitable means are provided for removably being attaching said decorative element to said main part of the footwear.

In this way it is possible to arrange, when buying, the required decorative element on the main part of the footwear.

By providing the retailer with a certain number of main footwear parts and a wide variety of decorative elements which can be engaged and disengaged therewith, it is possible to take steps so that, at the end of the sales season of the article, mainly the decorative elements alone, which can be engaged and disengaged with the main basic part of the item of footwear, remain unsold, and not a large quantity of whole items of footwear, as occurred to date. In this way a considerable saving is achieved in the quantity of material used for producing footwear, as also in the uses of energy and hours of work by staff required hitherto for producing footwear.

With the present invention an immediate advantage can also be achieved by purchasers who, should they intend change the model or features of appearance of their footwear, no longer have to buy a new pair of shoes, but can simply and at a low cost buy a new ornamental element to be placed on the item of footwear in place of the one previously present thereon.

The features and advantages of the present invention will in any case be made clearer by reading the following description which relates to preferred embodiments of the invention.

BRIEF DESCRIPTION OF THE DRAWINGS

The following description must be read with reference to the accompanying drawings, in which.

DESCRIPTION OF THE PREFERED EMBODIMENTS

Figure 1:
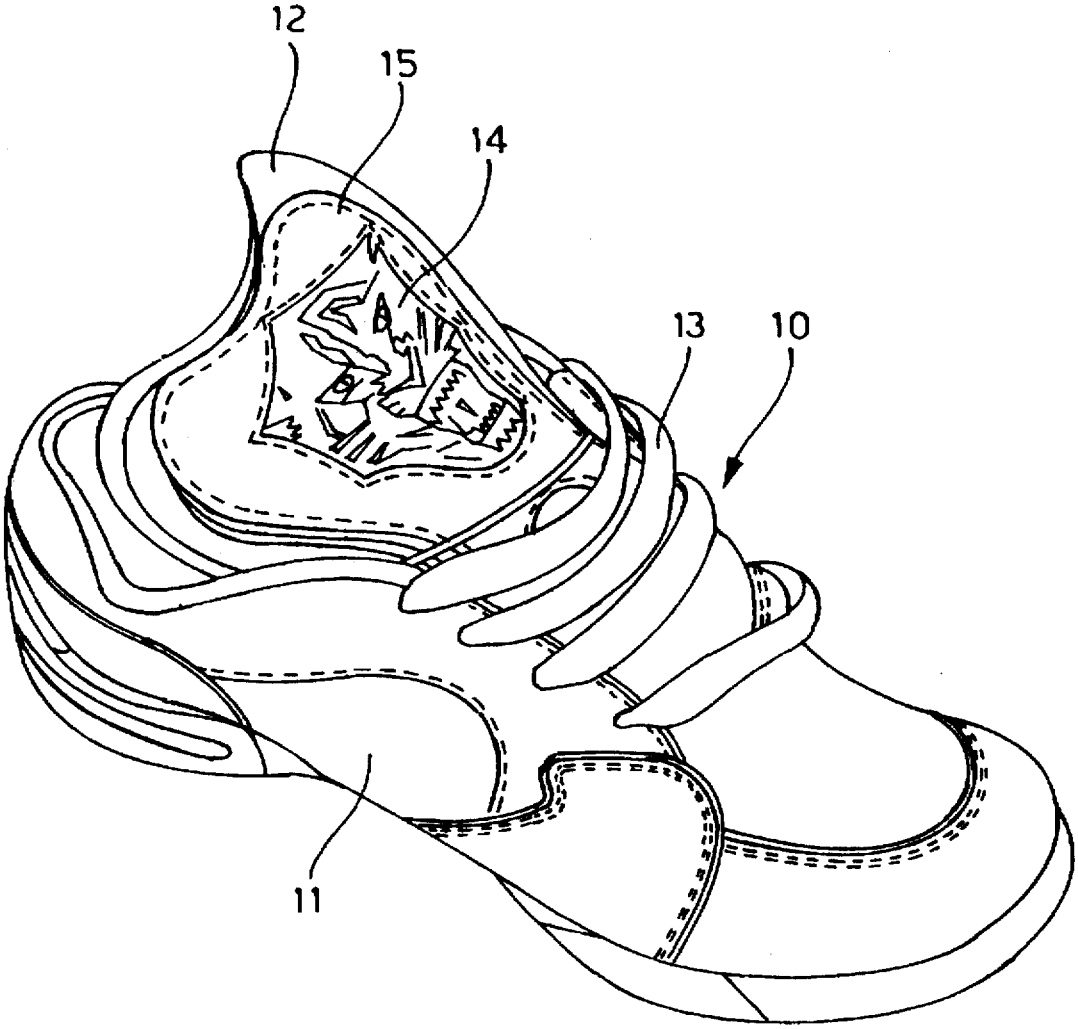
FIG. 1 is a perspective view of a shoe made in accordance with a first preferred embodiment of the present invention.

FIG. 1 illustrates an item of footwear 10, in the form of a sports shoe, comprising a main shoe part 11 and a tongue 12 which is positioned above the foot between the latter and the parts for fastening the shoe, in this case consisting of laces 13. As shown, the shoe 10 has a tongue 12 which is provided with said decorative element 14, which in the embodiment shown is given, as an example, as a tiger's face.

According to this first preferred embodiment, provision is made to removably attach said decorative element 14 to the main footwear part 11, using a special support element 15 which is connected in an engageable and disengageable manner to the main shoe part 11.

Also referring to the other FIGS. from 2 to 6, it can be seen that the support element 15 is in the form of a flat element having a hole in the center for housing the decorative element 14, in such a way as to provide a sort of frame or flat strip which surrounds and firmly restrains said decorative element. The internal edge 15*a* of the flat support strip 15 is parallel and positioned near to the external edge 14*a* of the decorative element 14.

For removable attachment of the decorative element to the shoe, attachment means are then provided comprising a first and a second part 16, 17 respectively which can be coupled one to the other and which are integral with said strip 15 and with the surface of the footwear respectively, in this case, in the preferred embodiment shown here, with the upper surface 18 of the tongue 12 of the shoe.

As shown, said means for removable attachment are, in this embodiment, formed by a VELCRO hook and loop fastener type tape and comprise a first portion of VELCRO tape, defining the first part 16 of the attachment means, attached below the flat support strip 15 of the decorative element 14 and a second portion of VELCRO tape, defining said second part 17 of the attachment means, which is suitable for coupling with said first VELCRO portion and is attached on the upper surface 18 of said tongue 12.

The attachment system known on the market by the name "VELCRO" is a hook and loop fastening system fully known to an expert in the field and it is not considered necessary therefore to describe it here in detail.

In the embodiment shown, said portion 17 of the VELCRO tape provided on the upper surface 18 of the tongue 12 has a configuration which exactly matches the shape of the support element 15 and of the first VELCRO strip 16 borne by it. It is attached to the surface of the footwear by yarn stitches. Two stitches 19 and 20 are placed near and parallel respectively to the outer edge 21 and the inner edge 22 of the second portion 17 of the VELCRO tape.

Figure 2:
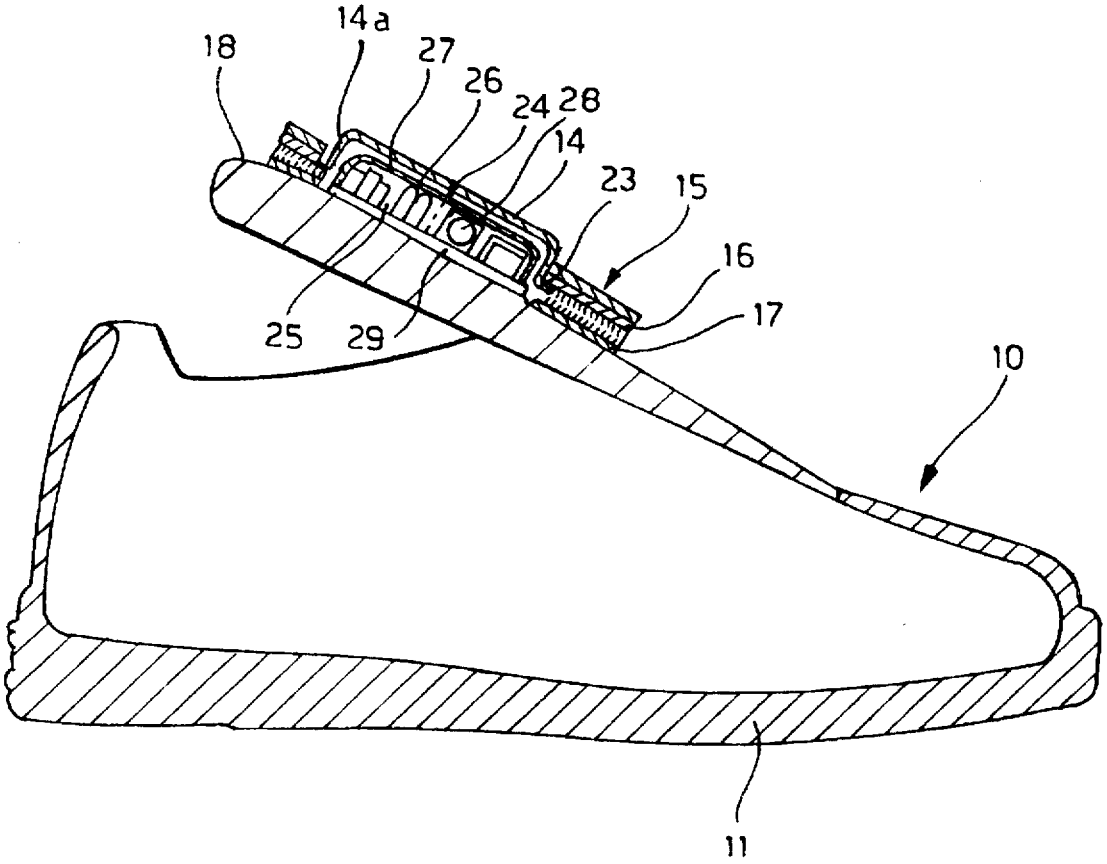
FIG. 2 is a sectioned view of the shoe according to the first preferred embodiment of the present invention.
Figure 3:
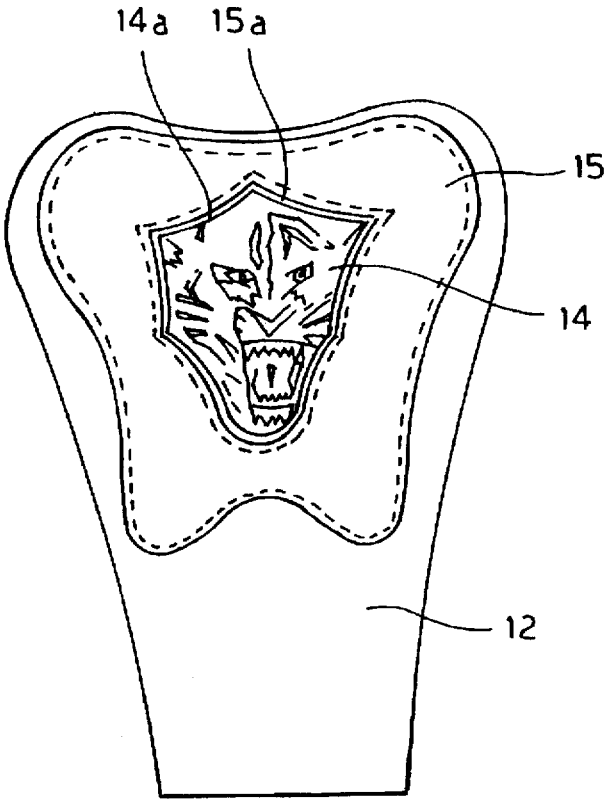
FIG. 3 is a plan view from above of the tongue alone of the shoe of the first preferred embodiment with the decorative element attached.
Figure 4:
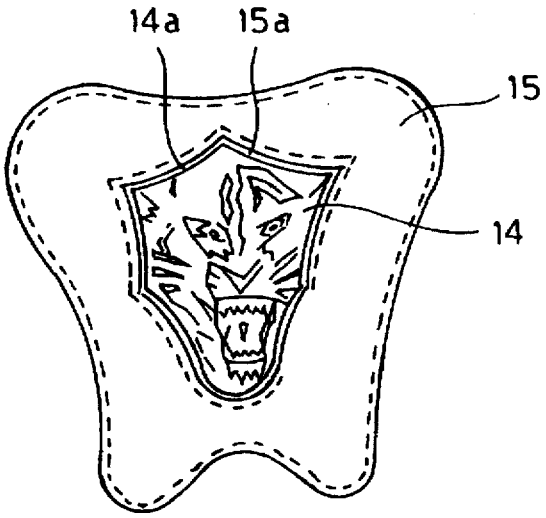
FIG. 4 is a plan view from above of the decorative element and of the flat support strip which can be attached removable to the tongue of the shoe according to the first preferred embodiment of the present invention.
Figure 6:
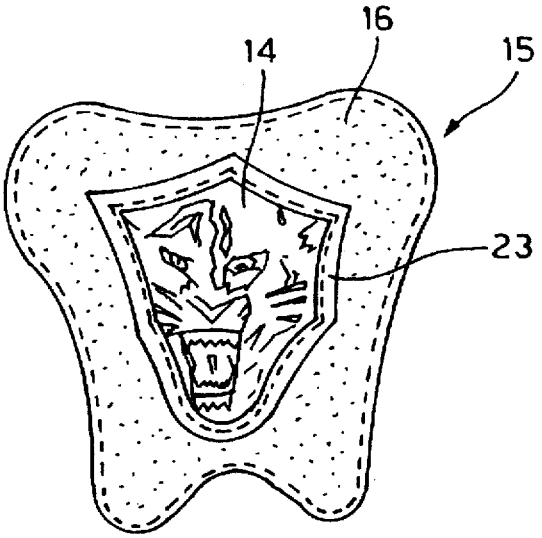
FIG. 6 is a plan view from below of the decorative element and of the support strip which can be attached removable to the tongue of the shoe according to the first preferred embodiment of the present invention.

In the same way, the decorative element 14 is attached to the flat strip 15 and to the first portion 16 in VELCRO tape of the attachment means, as shown, by sewing with yarn along the corresponding inner and outer edges. More particularly, it is clear in FIGS. 2 and 6 how the stitching provided at the inner edges additionally connects a lower perimetral undercut 23 of the decorative element 14 positioned below the first portion 16 of the VELCRO tape, so as to connect the decorative element 14 to the support element 15.

The strip 15 is in a flexible material, for example leather or another material normally used for making the upper of shoes, but could also be provided in any other type, for example in a rigid or plastic material.

According to a further feature of the invention, in the case wherein it has been foreseen to use, as shown in the present preferred embodiment, light emission apparatus 24, positioned below the decorative element 14, made in a transparent material and actuated by the walking of the wearer of the item of footwear, provision is made to attach the apparatus 24 for light emission directly to the upper surface of the item of footwear, i.e. to the upper face 18 of the tongue 12.

In this case, in order to insulate the electric circuit and protect it from the outside, the second part 17 of said means for removable attachment, which are provided on the upper face of the footwear, are arranged around said light emission apparatus 24.

Said apparatus 24 comprises an electric circuit designed to actuate suitable light emission devices.

Said light emission apparatus 24 is of a wholly known type and is not therefore described in detail here. It comprises, as shown more particularly in FIG. 2, light emission parts 26 such as luminous leds or bulbs, connected by means of a suitable electric circuit 25, which can be produced by any expert technician, and supply batteries 28. The whole is supported by a rigid support plate 29.

Figure 5:
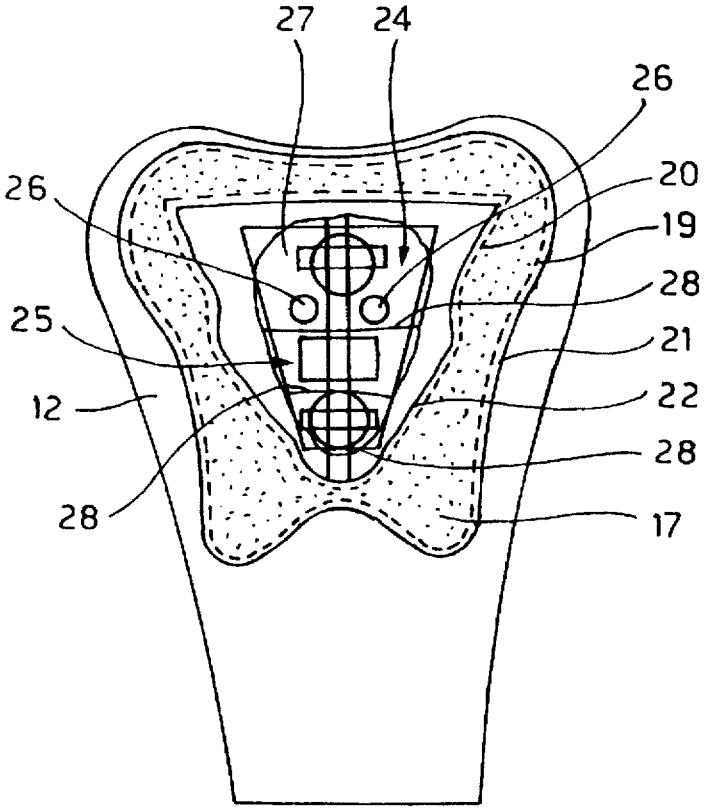
FIG. 5 is a plan view from above of the shoe of the first preferred embodiment, not provided with the decorative element, showing the part of the means for removable attachment which are positioned on the tongue itself, as well as the light emission apparatus.

As shown, said light emission apparatus 24, covered by a layer of transparent synthetic material 27 such as for example silicone, is attached to the surface of the footwear by means of sewing yarns, denoted by the reference numeral 28 in FIG. 5.

In addition to protecting the components of the light emission apparatus, the layer of silicone also maintains the supply batteries properly anchored to the latter. The proposed solution is further advantageous in that, by simply removing the decorative element and its support element, access is immediately gained to the light emission apparatus and it is thus possible to replace the run-down batteries. It is sufficient to remove the part of the silicone layer which covers the batteries and return it after having placed the new, charged batteries in position.

A considerable reduction in the number of light emission apparatuses which would however have to be used according to the prior art is achieved. According to the present solution each interchangeable decorative element no longer has to be provided with a corresponding optical emission apparatus, instead it is sufficient to provide a single illumination apparatus for each shoe with a considerable lowering in the costs borne by manufacturers.

The processes for placing the light emission apparatus 24 are simpler and faster for the present invention and do not cause that permanent damage to the shoe entailed by making cuts and openings in the footwear, as had to be performed hitherto when the apparatus 24 had to be installed in the footwear. In known items of footwear in fact the apparatus 24 was embedded in the footwear, and cuts had to be performed for its insertion inside the main footwear part and windows to allow illumination of the decorative element.

The simple cutting of the yarns 28 allows furthermore rapid removal of the apparatus 24 without leaving indelible traces on the upper face of the tongue 12.

It could also be foreseen, according to the present invention, to attach said light emission apparatus 24 to the surface of the shoe by parts which allow removability thereof. In this way it is possible to replace optical emission apparatus which is faulty or malfunctioning with new apparatus in perfect working order, or in any case to allow the user to engage or disengage the light emission apparatus 24 with the tongue 12 at his or her discretion according to the needs of the moment.

For example the light emission apparatus 24 may be attached to a first portion of a Velcro tape, with a second portion of the Velcro tape which can be coupled with the first which is integral with the surface of the footwear in a substantially similar manner to what is shown for attachment of the decorative element 14.

In this way the decorative element may be detached individually from the footwear without taking with it any portion of the footwear itself, and said light emission apparatus, in such a way as to provide an interchangeable decorative element which has a particularly low cost.

It is thus possible for the user to remove the decorative element simply and rapidly and attachment of the decorative element onto the shoe is sufficiently firm and safe, such as to prevent undesirable detachments from occurring.

It is naturally understood that, according to the invention, it can also be foreseen to provide an element for supporting the decorative element with a different configuration from that shown, and also to use means for disengageable attachment which are different from the aforementioned Velcro tape.

Figure 7:
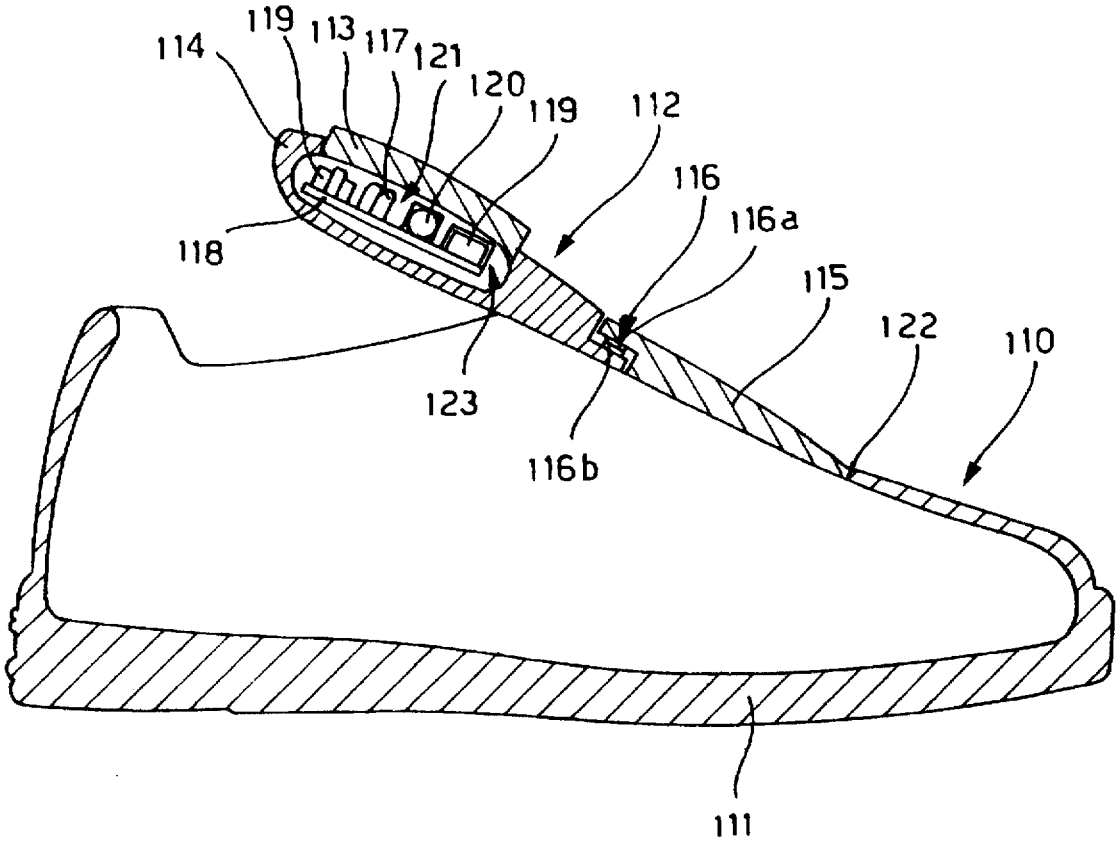
FIG. 7 is a sectioned view of the shoe made in accordance with the second preferred embodiment of the present invention.
Figure 8:
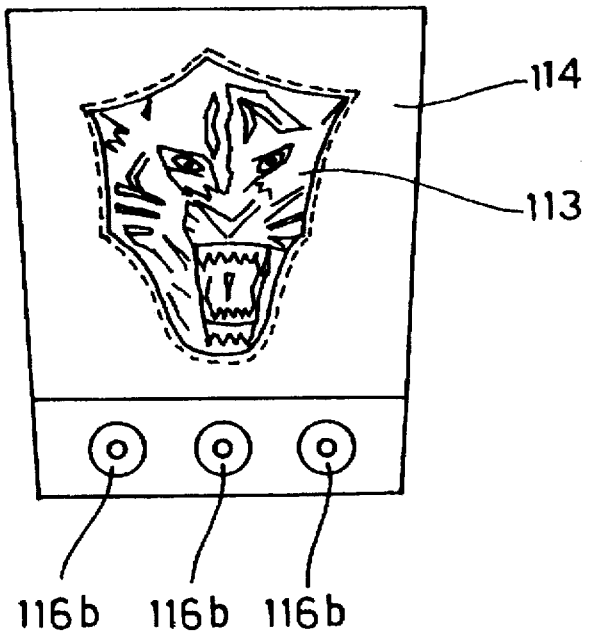
FIG. 8 is a plan view from above of the removable portion of the tongue of the second preferred embodiment of the present invention.
Figure 9:
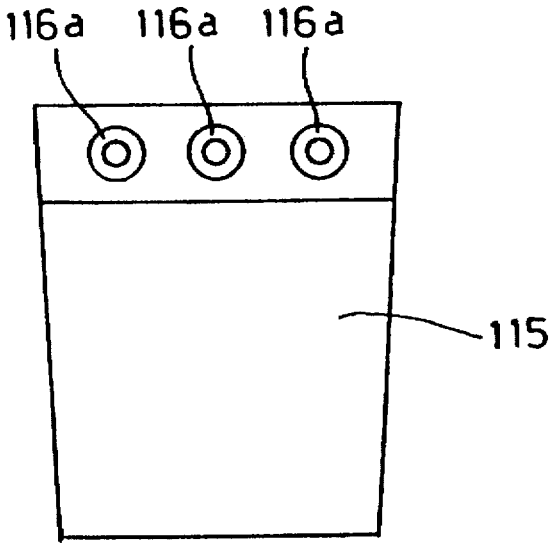
FIG. 9 is a plan view from below of the fixed portion of the tongue of the second preferred embodiment of the present invention.

FIGS. 7 to 9 illustrate a second preferred embodiment of the present invention.

FIG. 7 shows more particularly an item of footwear 110 in the form of a sports shoe comprising a main part of the shoe 111 and a tongue 112 which is positioned, above the foot, between the latter and the parts for fastening the shoe, in this case consisting of laces, and of the type wherein the tongue 112 of the shoe is provided with said decorative element 113 which, also in the second embodiment shown here, is given as an example as a tiger's face.

According to the invention provision is made to removably connect removable said decorative element 113 to the main part of the shoe. According to this preferred embodiment, the decorative element 113 is removably attached to the shoe 111 by providing an independent portion 114 of said tongue 112 whereon said decorative element 113 is placed and a portion 115 of said tongue 112 which is attached firmly to the main part of the shoe 111. Suitable reciprocal attachment means are arranged between the portion 114 and the portion 115, suitable for allowing removal of the portion 114 and its replacement with another similar portion nevertheless having another decorative element.

According to the present invention it could likewise be foreseen to arrange said means, suitable for removably attached said decorative element, directly between said tongue and said main part of the shoe, in the case wherein the tongue consists of a single main part and bears the decorative element.

According to the preferred embodiment shown in the figures, said means for removable attachment are in the form of press-studs 116, suitable for making the coupling particularly simple and rapid to perform. Said press-studs 116 each have a first coupling element **116*a*, arranged on said fixed portion 115 of the tongue, and a second coupling element 116*b*, designed to engage with and disengage respectively from said first element 116*a*, arranged on said removable portion 114 provided with the decorative element 113**.

As shown in FIGS. 7 and 8, said coupling element **116*b* of said removable tongue portion 114 provided with said decorative element 113 is preferably provided at the front end of said decorated portion, on the lower part of the same decorated portion 114 while, as shown in FIGS. 7 and 9, the corresponding coupling element 116*a* of said fixed portion 115 of the tongue is provided at the rear end of said fixed portion 115 on the lower face of the same fixed portion 115 of the tongue. The other end of this fixed portion 115 is firmly attached in 122 to the main part of the shoe 111**, as shown. In this way the attachment means are completely hidden and do not affect the external appearance of the shoe in any way.

In the preferred embodiment shown, said decorative element 113 in transparent material comprises a suitable light emission circuit 121 comprising light emission parts 117 actuated by a suitable electric circuit during walking of the wearer of the shoe.

Said light emission parts 117, like the actuation circuit, are fully known. FIG. 7 shows, in addition to the light emission device 117, the circuit-holder plate 118, the two supply batteries 119, 119 and the switch device 120.

According to a further feature of the present invention provision is made to place said electric light emission circuit 121 fully inside the removable portion 114 of the tongue 112, in a special housing concavity 123, open at the top and covered by the decorative element 14.

In this way it is possible to avoid the disadvantage shown by known shoes provided with a light emission device actuated by walking. In them in fact, once the supply batteries have run down, the illumination device being embedded inside the shoe and not accessible in any way from the outside, unless after having cut or split the same shoe, it was no longer possible to achieve any light emission.

It is possible with the present invention, once the batteries have run down, to replace the portion provided with the light emission device with a further portion having a same optical emission element, but with electrically charged illumination batteries, in order to provide a shoe wherein light emission can be guaranteed for the whole lifespan of the shoe itself. It is naturally understood that what has been written and shown with reference to the preferred embodiments of the present invention has been given purely by way of a non-limiting example of the principle claimed. Obviously, as already referred, the innovative concept of the present invention is not applied exclusively, albeit preferably, to a shoe, but can be extended also to any type of footwear provided with at least one decorative element.

What is claimed is:

1. An item of footwear comprising a body having a tongue and a light emission electric circuit attached thereto and having at least one light emission element, said light emission electric circuit being attached to said tongue; said item of footwear further comprising a decorative element which is substantially transparent to light, said decorative element being attached to said tongue overlying said light emission circuit to protect said light emission circuit;

and wherein removable attachment means are provided for removably attaching said decorative element to the item of footwear.

2. An item of footwear according to claim 1, wherein said decorative element is attached firmly to a support element and said removable attachment means are provided between said support element and the tongue.

3. An item of footwear according to claim 2, wherein said support element of the decorative element is a flat band element which surrounds the decorative element and is connected to an external perimeter of the decorative element at an inner edge of said decorative element.

4. An item of footwear according to claim 3, wherein said removable attachment means comprise a first coupling portion of hook and loop fastener tape on a surface below the flat band element of the decorative element and wherein on a surface of the tongue a second portion of the tape is attached, to couple with said first coupling portion integral with the decorative element, defining said second part of the removable attachment means of said item of footwear.

5. An item of footwear according to claim 3, wherein said second part of the removable attachment means is provided on an upper surface of said tongue of the footwear.

6. An item of footwear according to claim 5, wherein said light emission apparatus of the decorative element is attached to the upper face of the tongue of the item of footwear.

7. An item of footwear according to claim 6, wherein the second part of said removable attachment means of said flat band element of the decorative element is arranged around said light emission electric circuit.

8. An item of footwear according to claim 7, further comprising means for attaching said light emission electric circuit to the surface of the item of footwear engageably and disengageably.

9. An item of footwear according to claim 8, wherein said means for attaching said light emission apparatus are provided between a support plate of the light emission electric circuit and an upper face of the tongue of the item of footwear.

10. An item of footwear comprising a body attached thereto and having a tongue and a light emission electric circuit having at least one light emission element, said light emission electric circuit being attached to said tongue; said item of footwear further comprising a decorative element which is substantially transparent to light, wherein said decorative element is attached to said tongue overlying said light emission electric circuit, to protect the light emission circuit, wherein the tongue of the item of footwear comprises a fixed portion of tongue attached firmly, at its longitudinal front end, to the body of the footwear and a portion of tongue independent from the fixed portion of the tongue firmly attached to the body of the footwear, wherein removable attachment means for removably attaching the independent portion of said tongue to a rear longitudinal end of the fixed portion of said tongue attached firmly to the body of the shoe; and wherein said light emission electric circuit and said decorative element are attached to the independent portion of the tongue.

11. An item of footwear according to claim 10, wherein said removable attachment means comprise at least a first coupling element, placed on said fixed portion of the tongue, and a second coupling element engaging with and disengaging from, respectively, said first coupling element on said fixed portion of the tongue, placed on said independent portion provided with the decorative element.

12. An item of footwear according to claim 11, wherein said first coupling element and said second coupling element are two parts of a press-stud.

13. An item of footwear according to claim 12, wherein said second coupling element of said independent portion of tongue, provided with said decorative element, is placed on a lower face of said decorative portion and wherein said first coupling element of said fixed portion of the tongue is placed on an upper face of said fixed portion of the tongue.

14. An item of footwear according to claim 13, wherein said second coupling element of said independent portion of the tongue, provided with said decorative element, is placed at a front longitudinal end of said independent portion.

15. An item of footwear comprising a body having a tongue, and further comprising a decorative element, attached thereto wherein the tongue of the footwear comprises a fixed portion of the tongue attached firmly, at its longitudinal front end, to the body of the footwear and an independent portion of tongue which is independent from the fixed portion of tongue firmly attached to the body of the footwear, wherein removable attachment means are provided between the independent portion of said tongue and a rear longitudinal end of the fixed portion of said tongue attached firmly to the body of the footwear; and wherein said decorative element is attached to the independent portion of the tongue.

* * * * *